United States Patent [19]

Kubokawa

[11] 4,077,514

[45] Mar. 7, 1978

[54] BALL HOLDER

[76] Inventor: Masaharu Kubokawa, No. 3-11-8 Minami-Nagasaki, Toshima-ku, Tokyo, Japan

[21] Appl. No.: 631,393

[22] Filed: Nov. 12, 1975

[51] Int. Cl.[2] ..... B65D 85/00

[52] U.S. Cl. ..... 206/315 B; 211/14; 211/49 R; 220/19; 224/5 D; 224/45 L

[58] Field of Search ..... 224/5 R, 5 D, 5 MA, 224/26 R, 45 L, 5 C; 206/315 B; 150/52 A, 52 G, 1.5 C, 48, 50; 273/61 D; 211/14, 49 R, 181; 24/3 D; 294/19 A; 248/102; 220/19

[56] References Cited

U.S. PATENT DOCUMENTS

| | | | |
|---|---|---|---|
| 584,906 | 6/1897 | Tribolet | 211/49 R |
| 1,561,201 | 11/1925 | Wocel | 211/49 R |
| 1,778,225 | 10/1930 | Morss | 224/5 D X |
| 2,355,108 | 8/1944 | Reese | 206/315 B |
| 2,516,997 | 8/1950 | Kellinger | 224/5 D X |
| 2,538,612 | 1/1951 | Wuollett | 211/49 R X |
| 2,544,053 | 3/1951 | Sharaf | 211/49 R X |
| 3,058,708 | 10/1962 | Murray | 248/102 |
| 3,371,795 | 3/1968 | Rosonke | 211/14 |
| 3,756,299 | 9/1973 | Simmons | 224/5 D X |
| 3,952,876 | 4/1976 | Price | 211/181 X |
| 3,980,215 | 9/1976 | Schwarzbauer | 224/5 D |
| 3,984,138 | 10/1976 | Brunner | 294/19 A |

FOREIGN PATENT DOCUMENTS

| | | | |
|---|---|---|---|
| 1,498,089 | 11/1968 | Germany | 224/45 P |
| 553,410 | 5/1943 | United Kingdom | 206/315 B |

*Primary Examiner*—Galen L. Barefoot
*Assistant Examiner*—Winston H. Douglas
*Attorney, Agent, or Firm*—Haseltine, Lake & Waters

[57] ABSTRACT

A basket-like tennis ball holder which comprises a body portion consisting of four slender metal rods provided at the top end with an opening and at the bottom end with supporting members connecting by means of a bottom plate, looped legs each of which is formed by bending the bottom of a rod downwardly and radially outwardly, and a ring member fixed around the rods closer to the opening.

1 Claim, 8 Drawing Figures

BALL HOLDER

FIELD OF THE INVENTION

This invention relates to a ball holder for holding balls and more particularly to a basket-like ball holder for tennis balls.

THE PRIOR ART

Conventionally, regulation tennis balls commercially available are packed under pressure in a can. For use the tennis balls must be taken out of the can by breaking the seal adjacent to the cap at the top of the can, and removing the cap. More particularly, the can is provided with a stripe seal having a frangible tip formed integrally around the can just below the cap of the can. When the tennis balls are taken out of the can, the tip is pulled by using an associated tool or directly by hand for breaking off the seal. In this case, the cut ends of the can and the stripe seal are sharp-edged. Young people are frequently injured by such sharp-edged cut ends.

The conventional can is generally a relatively long tube and its bottom is flat. Therefore, when it is set upright, it is easily overturned by a slight external force, for example, a gentle wind, and when it is horizontally placed, a slight external force causes it to roll, so that the cap can possibly become removed and, hence, the tennis balls roll out of the can and are scattered about.

Further, in the case of the conventional can, it is impossible to know how many balls or what color balls are packed in it, since the holder is made of opaque metal.

SUMMARY OF THE INVENTION

Accordingly, an object of the present invention is to provide a ball holder, particularly, for tennis balls which is safe in handling, stable in construcion and enables one to know the state of balls in the ball holder, for example, the number and the color of the balls.

This invention may be briefly summarized as comprising a main body consisting of at least three slender metal rods equingularly arranged and provided at the top end with an opening permitting a ball to pass therethrough and at the bottom end with supporting members for holding the balls, each of which is formed by binding said rod downwardly and radially outwardly, and a ring member fixed to said rods closer to said opening.

Other objects and advantages of the present invention will be apparent from the following detailed description, taken in connection with the accompanying drawings, wherein:

DETAILED DESCRIPTION

Figure 1:
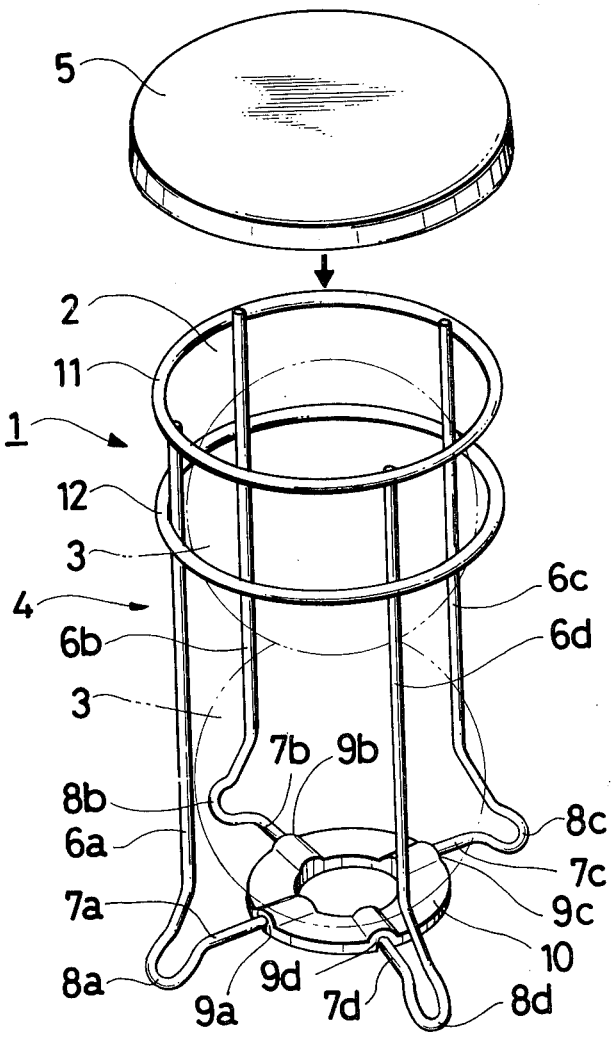
FIG. 1 shows a perspective view of an embodiment of a ball holder according to the present invention.
Figure 2:
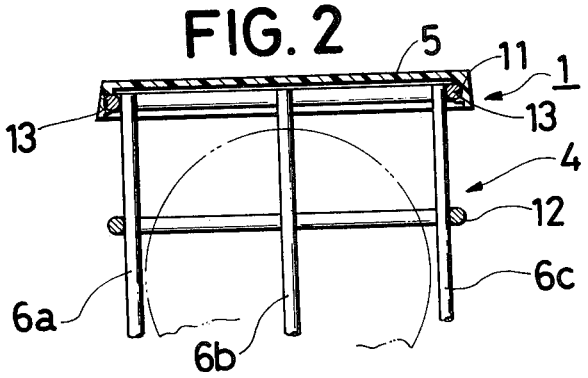
FIG. 2 is a cross-sectional view of a cap on the ball holder of FIG. 1.

In the drawings, like reference numerals are used to designate like and equivalent components.

Figure 3:
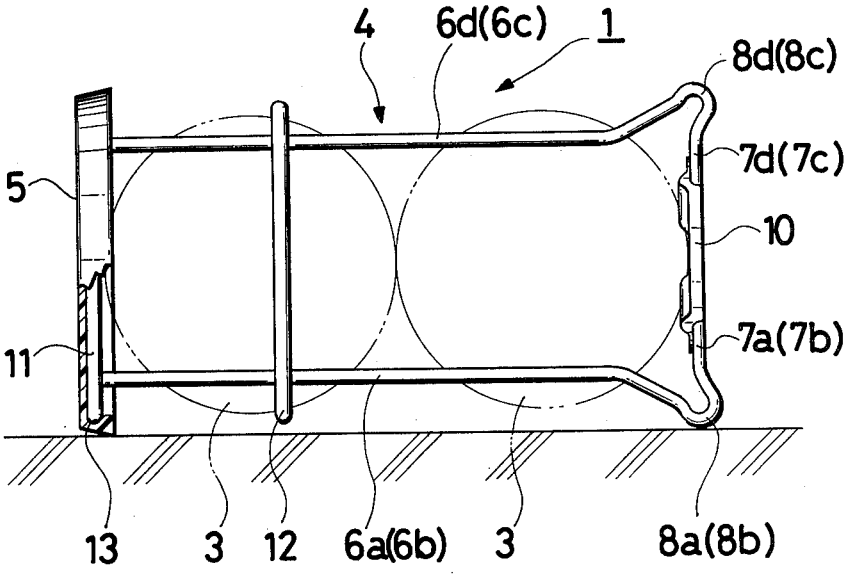
FIG. 3 is a view illustrating the ball holder of FIG. 1 horizontally placed.

Referring now to FIG. 1, there is shown an example of a basket like ball holder 1 according to the present invention. the ball holder 1 comprises a ball holder body 4, a bottom portion 4*a*, and a cap 5. The ball holder body 4 consists of four slender metal rods 6*a*, 6*b*, 6*c* and 6*d* preferably equiangularly arranged, a ring 11 enclosing the top ends of the metal rods and secured to them by welding, and another ring 12 disposed below the ring 11 and similarly secured to the metal rods. These rings cooperate to define an opening 2 for introduction of tennis balls 3 into the holder body 4 one by one. the cap 5 is removably put on the ring 11 for covering the opening 2 so as to prevent the balls in the holder 1 from dropping out of the holder 1. The cap 5 may be made of plastic, metal or any other suitable material. A groove 13 for receiving the ring 11 when the cap 5 is put on the top of the ball holder body 4, is provided in the inner wall of the cap 5. At the bottom portion 4*a*, the four slender rod members, respectively, are bent inward normal to the rod columns 6*a*, 6*b*, 6*c* and 6*d* to form supporting members 7*a*, 7*b*, 7*c* and 7*d* for supporting a bottom metal plate 10 with a hole in the center. The respective bent portions between the supporting members 7*a*, 7*b*, 7*c* and 7*d* and the rod columns 6*a*, 6*b*, 6*c* and 6*d* are incurved to form looped legs 8*a*, 8*b*, 8*c* and 8*d* each projecting downwardly and radially outwardly as seen in the drawing. The bottom plate 10 is provided with four depressions angularly arranged on the periphery of the bottom plate 10, as seen partially in FIGS. 3 and 5. The supporting members 7*a*, 7*b*, 7*c* and 7*d* are fitted into the corresponding depressions 9*a*, 9*b*, 9*c* and 9*d* and these are fixedly connected by welding. Instead of the depressions, relatively deep holes mau also be used. In this case, the supporting members are selected to be longer than the previous case, and are tightly fitted into the holes. Further, those supporting members may be directly connected preferably at the center of the bottom by welding or they may be connected by means of a ring without the use of the bottom plate 10. In this example, the bottom plate 10 is made of metal; however, the material for the bottom plate may be any suitable material, for example, plastic. The rod columns 6*a*, 6*b*, 6*c* and 6*d*, the rings 11 and 12 are preferably made of rustless steel and colored in harmony with court accessories for example. Furthermore, it will be understood that three rod columns may suffice to hold the tennis balls, although four rod columns are employed in this example.

Thus constructed, the basket-like ball holder 1 can stand as shown in FIG. 1. More precisely, since the ball holder 1 is supported by means of four looped legs 8*a*, 8*b*, 8*c* and 8*d*, it can stably be placed on the ground, even if the ground is slanted or uneven, and the holder is subjected to a gentle wind. When the ball holder 1 is horizontally placed, it is supported on two looped legs and at least one contact point between the ground and the rings 11 and/or 12. Thus, it is insured that the ball holder 1 is stably placed. it is to be noted, here, that the tennis balls held in the holder 1 does not contact the ground, as seen, for example, in FIG. 3.

The cap 5 put on the opening 2 prevents the tennis balls in the holder from dropping therefrom, when the ball holder 1 is laid down. Further, the ball holder 1 is of basket construction. Therefore, the state of the tennis balls held in the ball holder 1 can directly be seen from the outside. That is, inspection can be made as to how many balls are held in the ball holder or what is the color of the balls in the ball holder or the degree of wear of the tennis balls.

Figure 4:
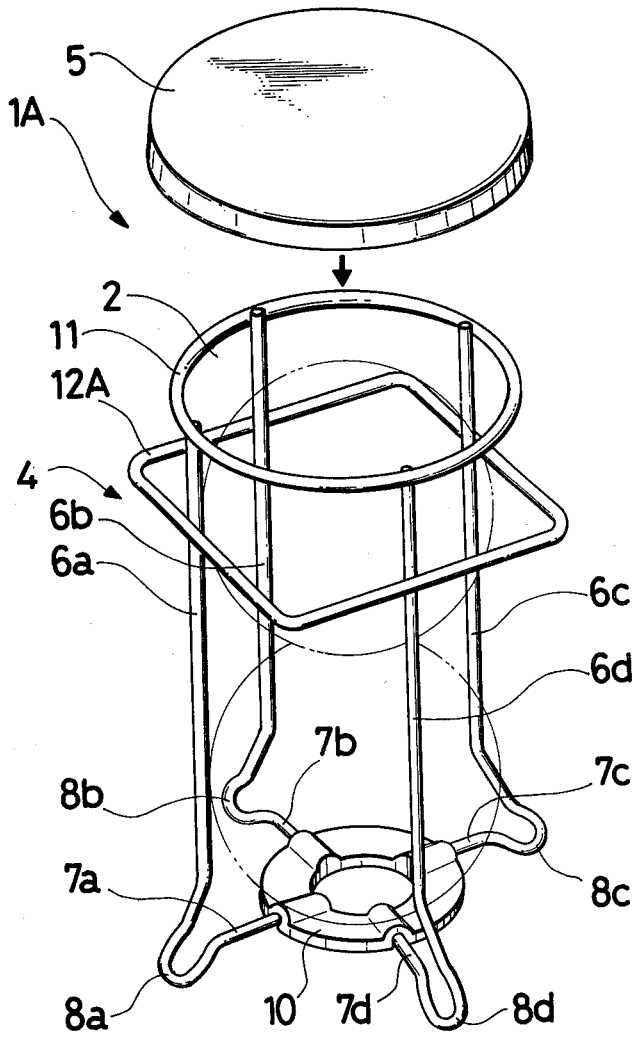
FIG. 4 is a perspective view of another embodiment of a ball holder according to the present invention.

FIG. 4 shows another embodiment of a ball holder according to the present invention.

Figure 5:
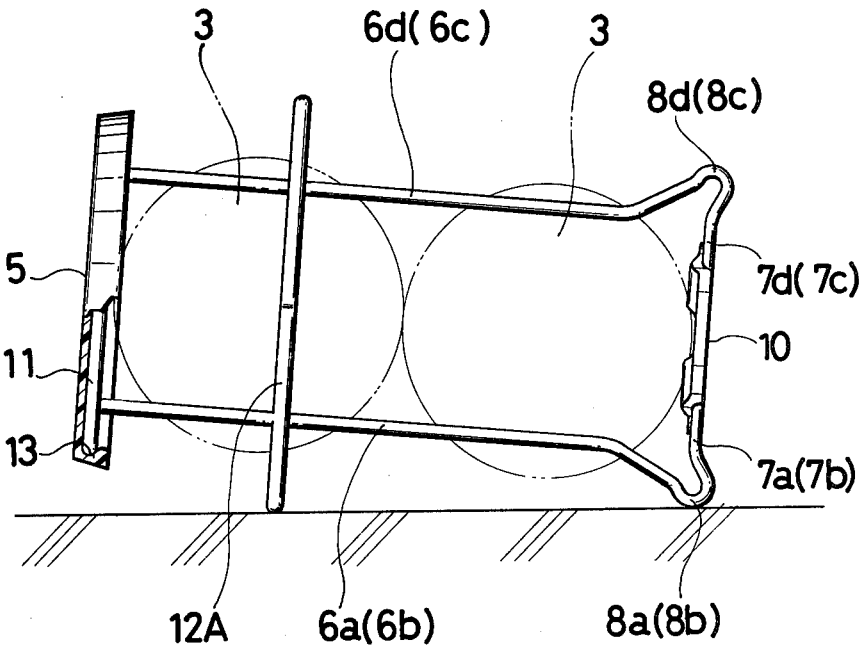
FIG. 5 is a view illustrating the ball holder of FIG. 4 when it is horizontally placed.

This embodiment has the feature that, instead of the circular ring 12 in the previous example, a square ring 12A is used whose corners are each disposed on a line passing approximately midway between adjacent looped legs. With such construcion, the ball holder 1 is supported by three points, i.e. any one of the corners and adjacent looped legs when it is horizontally placed, as shown in FIG. 5.

Figure 6:
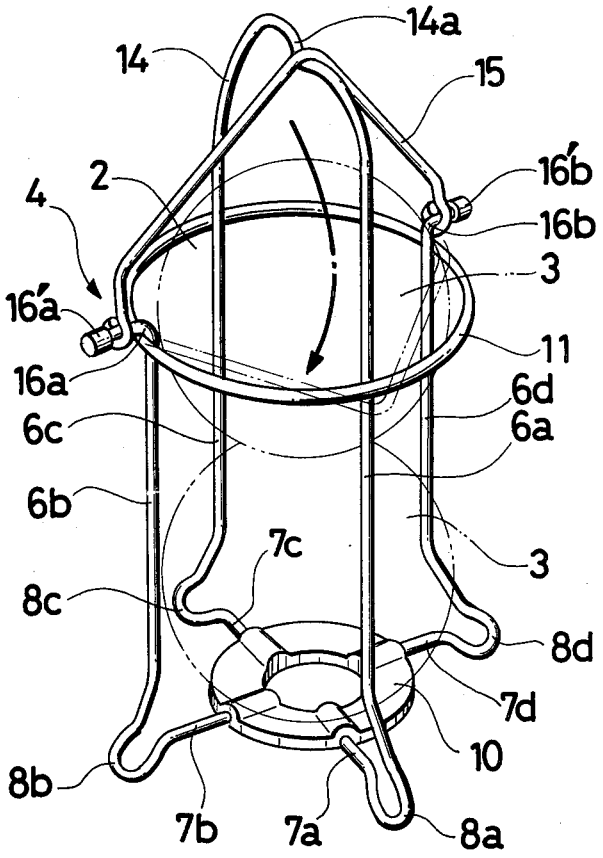
FIGS. 6 and 7 are perspective views of still another modification of a ball holder according to the present invention.

FIG. 6 shows another modification of a ball holder according to the present invention. The difference from the previous holders resides in the construcion of the top portion of the ball holder 1. More precisely, a pair of rod columns, for example, 6*a* and 6*c*, extend to form a bridge 14 above the opening 2. The bridge 14 has a depression 14*a* formed substantially at the top of the bridge 14. Another pair of rod columns, for example, 6*b* and 6*d*, are bent at right-angles at the respective top ends to form hooks 16*a* and 16*b*, respectively. Another bridge 15 which acts as a stopper, as will be seen below, is rotatably mounted across the top end of the ball holder 1, more particularly on respective hooks 16*a* and 16*b*. The bridge 15, in normal condition, is stably engaged in the depression 14*a*. When one wants to put tennis balls into the ball holder 1, the bridge 15 is rotated in the direction indicated by the arrow to provide space for the introducion of the tennis balls one by one. It is, of course possible, to turn the bridge 15 in the opposite direction for the introduction of the tennis ball. After the introducion of the tennis balls is completed, the bridge 15 is turned back to the depression 14*a*, preventing the balls from dropping from the ball holder 1. The hooks 16*a* and 16*b* are preferably provided, at the respective tips, with caps 16'*a* and 16'*b*, respectively, for protection. That is, since the cut ends or the tips of the hooks 16*a* and 16*b* are often sharp edged, one may possibly be injured.

Figure 7:
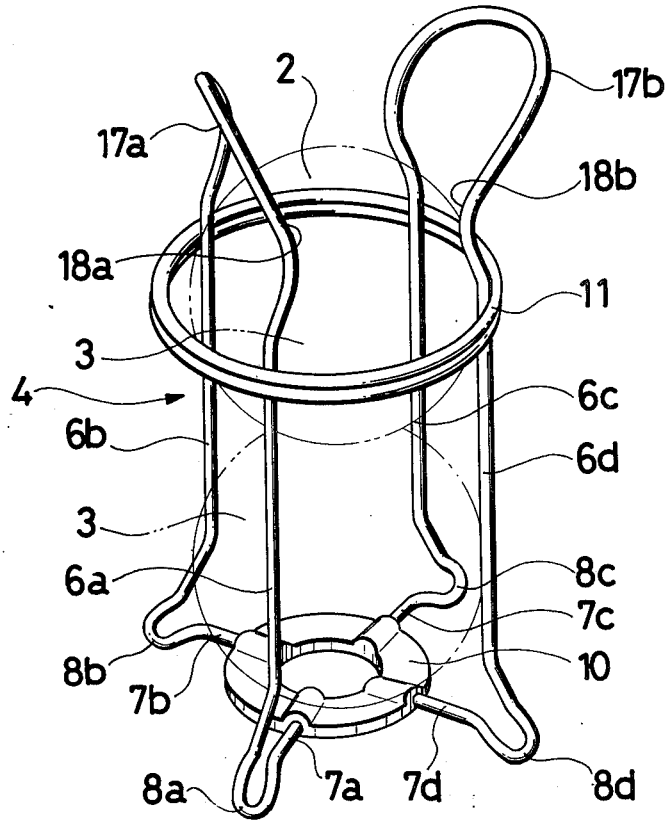
Figure 8:
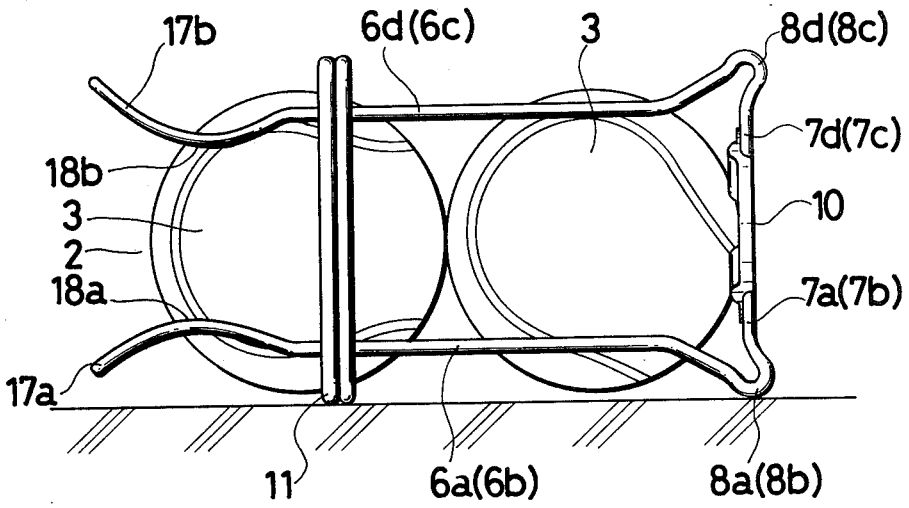
FIG. 8 shows the ball holder of FIG. 7 when it is horizontally placed.

Still another embodiment of a ball holder according to the present invention will be described with reference to FIGS. 7 and 8.

In this example, loops 17*a* and 17*b* are formed above the opening 2 by joining respective adjacent slender rod columns, for example, 6*a* and 6*b*, and 6*c* and 6*d*. The curved loops 17*a* and 17*b* are bent to form curvature portions 18*a* and 18*b*, respectively in order that the space between the tops of the respective curvature portions 18*a* and 18*b* is slightly less than a diameter of the regulation tennis ball. When one wants to put tennis balls into the ball holder, the tennis balls are thrust into the space between portions 18*a* and 18*b* to forcibly expand the space, i.e. to bend the loops 17*a* and 17*b* outwardly, whereafter the balls can enter the ball holder 1. Since, in a normal condition, the distance between the confronting curvature portions 18*a* and 18*b* is less than the diameter of the tennis ball, the tennis balls are reliably held in the ball holder 1 without fear of their dropping therefrom. Thus, the employment of the loops 18*a* and 18*b* eliminates the need of an additional cap. Incidentally, in this example, two rings 11 are employed to enhance the mechanical strength at the entrance of the ball holder 1.

This invention has been described in conjunction with ball holders each having a capacity of holding two balls. But, it is seen that the ball holding capacity is further expandable. Further, the ball holder according to the present invention is applicable to balls other than regular tennis ball, for example, soft-tennis balls, baseballs, or the like.

While the present invention has been described herein as carried out in a specific embodiment thereof, it is not desired to be limited thereby but it is intended to cover the invention broadly within the spirit and scope of the appended claims.

What is claimed is:

1. A normally vertically upstanding ball holder for tennis balls comprising:

a main body (4) including four relatively slender metal rods (6*a* – 6*d*) equiangularly arranged around a longitudinal axis, said body being provided at the top end thereof with an opening (2) permitting a ball to pass therethrough and four supporting members (7*a* – 7*d*) disposed at the bottom of said body;

four looped legs (8*a* – 8*d*) attached to said supporting members, respectively, each of said looped legs being formed at the bottom of said holder by bending each of said rods downwardly and radially outwardly;

an enclosing means (11) attached around said rods in the vicinity of said opening (2), and a bottom support plate (10), said supporting members having inner ends connected to said bottom plate (10), said bottom plate having on the periphery thereof four depressions for receiving and being fixedly connected to respective ends of said supporting members, said bottom plate having a central aperture in which the lowermost ball in the ball holder can partially project, a cap (5) removably fitted on the top end of said main body, and a square enclosing device (12A) attached around said rods and disposed relatively close to said enclosing means, said enclosing device having four sides each making contact at the center thereof with a corresponding one of said rods, said enclosing device having corners disposed equidistantly between adjacent respective rods so that when the holder is placed horizontally on its side on a support surface, it can rest on one of said corners and on two of said lopped legs whereby the holder is stably supported and the balls in the holder do not contact the support surface.

* * * * *